US006650294B2

(12) United States Patent
Ying et al.

(10) Patent No.: US 6,650,294 B2
(45) Date of Patent: Nov. 18, 2003

(54) COMPACT BROADBAND ANTENNA

(75) Inventors: Zhinong Ying, Lund (SE); Anders Dahlström, Vellinge (SE)

(73) Assignee: Telefonaktiebolaget LM Ericsson (publ), Stockholm (SE)

( * ) Notice: Subject to any disclaimer, the term of this patent is extended or adjusted under 35 U.S.C. 154(b) by 0 days.

(21) Appl. No.: 09/991,997

(22) Filed: Nov. 26, 2001

(65) Prior Publication Data

US 2003/0098812 A1 May 29, 2003

(51) Int. Cl.[7] ..... H01Q 1/38

(52) U.S. Cl. ..... 343/700 MS; 343/702; 343/846

(58) Field of Search ..... 343/700 MS, 702, 343/815, 816, 817, 829, 846, 848; H01Q 1/38

(56) References Cited

U.S. PATENT DOCUMENTS

| | | | | |
|---|---|---|---|---|
| 5,008,681 A | * | 4/1991 | Cavallaro et al. | 343/700 MS |
| 5,786,793 A | * | 7/1998 | Maeda et al. | 343/700 MS |
| 5,955,994 A | | 9/1999 | Staker et al. | |
| 6,008,762 A | | 12/1999 | Nghiem | |
| 6,114,996 A | * | 9/2000 | Nghiem | 343/700 MS |
| 6,236,367 B1 | * | 5/2001 | Du Toit et al. | 343/700 MS |
| 6,323,810 B1 | * | 11/2001 | Poilasne et al. | 343/700 MS |
| 6,414,637 B2 | * | 7/2002 | Keilen | 343/700 MS |

FOREIGN PATENT DOCUMENTS

| | | |
|---|---|---|
| EP | 1024552 A2 | 8/2000 |
| EP | 1146590 A2 | 10/2001 |
| JP | 7-131234 | 5/1995 |
| JP | 10-93332 | 4/1998 |
| WO | WO96/27219 | 9/1996 |
| WO | WO98/44588 | 10/1998 |
| WO | WO99/03168 | 1/1999 |
| WO | WO01/24314 | 4/2001 |

OTHER PUBLICATIONS

Rowell, C.R. et al.: "A Compact PIFA Suitable for Dual–Frequency 900/1800–MHZ Operation", IEEE Transactions on Antennas and Propagation, IEEE Inc. New York, US, vol. 46, No. 4, Apr. 1998, pp. 596–598 XP002905403 ISSN: 0018–026X.

* cited by examiner

*Primary Examiner*—Tho Phan
(74) *Attorney, Agent, or Firm*—Burns, Doane, Swecker & Mathis, L.L.P.

(57) ABSTRACT

Broadband multi-resonant antennas utilize capacitive coupling between multiple conductive plates for compact antenna applications. The number and design of conductive plates may be set to achieve the desired bandwidth. In one exemplary embodiment the antenna may be designed for four resonant frequencies and may include three L shaped legs each including a micro-strip conductive plate and connection pin, with configurations approximately parallel to one another. The center L shaped leg may be a feed patch with a feed pin connected to a transmitter, receiver, or transceiver. The upper L shaped leg may be a dual band main patch and ground pin. The dual band main patch may have two different branches with different lengths and areas to handle three of four desired resonant frequencies. The lower L shaped leg may be a parasitic high band patch and ground pin designed to handle one of the two higher desired resonant frequencies.

30 Claims, 7 Drawing Sheets

COMPACT BROADBAND ANTENNA

FIELD OF THE INVENTION

The present invention pertains to antennas. In particular, the invention relates to compact antennas with increased bandwidth.

BACKGROUND OF THE INVENTION

Antennas are an important component of all wireless communication systems and are particularly important for mobile wireless communication terminals (e.g., wireless telephones, personal communication devices, personal digital assistants (PDA), portable global position system (GPS) devices, web pads, laptop personal computers (PC), tablet PC, etc.). Over time, these mobile wireless communication devices have become smaller in size and lighter in weight. This is particularly true for wireless telephones.

Further, more and more functionality is being incorporated into wireless telephones and personal communication devices. In fact, various devices are starting to be combined into a single all-in-one personal computing and communication device that may need wireless communications with broader frequency bandwidth, for example, having multiple frequencies. Such devices could be supported by multiple antennas incorporated in the single multi-function device. However, multiple antennas generally would require multiple transceivers or a more complex transceiver with some type of power driver network for splitting the drive signal among the plurality of antennas and a method of switching between the plurality of antennas. This would add size and weight to the mobile device.

The increased device functionality and reduction in device size and weight of wireless mobile communication devices continues to push the emergence of antenna designs that are more compact and lightweight, and have broader bandwidth communication capability. Now and in the future, more compact lightweight antenna designs with broader bandwidth are needed for mobile wireless devices, particularly antennas that operate in the 300 MHz–3000 MHz frequency range. However, a single antenna having smaller size and broader bandwidth may be difficult to achieve because bandwidth is generally proportional to the volume of an antenna. Therefore, a compact or miniaturized antenna that would be small in area and lightweight will typically result in narrow bandwidth.

A number of compact and multi-frequency-band antennas have been proposed. For example, micro-strip or patch antennas, such as the planar inverted-F antenna (PIFA) has been used for mobile telephones. (See, for example, K. Quassin, "Inverted-F antenna for portable handsets", IEEE Colloqium on Microwave Filters and Antennas for Personal Communication Systems, pp. 3/1–3/6, February 1994, London, UK.) As suggested by its name, a patch antenna includes a patch or conductive plate. The length of the patch is set relative to the wavelength $\lambda_0$ of a desired transmission and/or reception frequency. A quarter wave patch antenna will have the length of the patch set at ¼ $\lambda_0$. FIGS. 1A and 1B provide an exemplary prior art PIFA 100. Referring to FIG. 1A, the PIFA includes a ground plane 105, a planar patch 110, a grounding pin 120, and a feeding pin 115. A signal source and/or receiver 125 is connected to the feeding pin 115 for radio wave reception and/or transmission to and/or from the PIFA. The feeding pin 115 is connected to the planar patch 110 and signal source and/or receiver 125. The planar patch 110 is connected to the ground plane 105 by ground pin 120. FIG. 1B is a cross section view of the PIFA taken across line IB of FIG. 1A. The planar patch 110 of PIFA 100 provides the resonating antenna surface for wireless communications over the air waves. Although small in size, the PIFA has a relatively narrow bandwidth. The bandwidth is limited mainly by the height of the patch 110 relative to the ground plane 105.

Micro-strip antennas are low profile, small in size and light in weight. However, as mobile wireless communication devices become smaller and smaller, both conventional microstrip patch and PIFA antennas may be too large to fit the small mobile device chassis or the space available for an antenna(s) in a multi-function wireless device. This is particularly problematic when new generation mobile wireless communication devices need multiple frequencies (and possibly multiple antennas) for cellular, wireless local area network, GPS and diversity (e.g., Global System for Mobile communications (GSM) and Personal Communication System (PCS)).

Recently, Lai, Kin, Yue, Albert et al. proposed in Patent Cooperation Treaty (PCT) publication No. WO 96/27219 a meandering inverted-F antenna. With this antenna the size can be reduced to about 40% of conventional PIFA antenna.

Some devices, such as the all-in-one device (e.g., an integrated PDA and telephone) or a mobile telephone with diversity may be served by a multi-band antenna. Typically in the past, multi-band antennas have been directed to supporting two operating frequencies. One such antenna is the dual-frequency band PIFA proposed by David Ngheim in PCT publication WO 98/44588. This antenna has two separate adjacent patches that resonate at different frequencies that are interconnected by a common electrical single feed connection. Another such antenna was proposed by Davie Ngheim in U.S. Pat. No. 6,008,762. This antenna uses a folded quarter wave patch antenna to achieve dual frequency band operation. A still further dual-frequency antenna has been proposed by Rowell and Murch in the paper titled "A Compact PIFA Suitable for Dual-Frequency 900/1800-MHz Operation," IEEE Transactions on Antennas and Propagation, Vol. 46, No. 4, April 1998. This antenna includes a capacitive feed and a capacitive load.

Unfortunately, none of the previously proposed antennas provide a satisfactory solution for the small size, light weight, broad bandwidth coverage needed by the upcoming new generations of wireless mobile communication devices operating in the 300 MHz–3000 MHz frequency range with minimal antenna return power loss. In particular, one recently developed application calls for a multi-function four band (quad-band) mobile terminal covering GSM800 (824–894 MHz), GSM900 (880–960 MHz), GSM1800 (1710–1880 MHz) and GSM1900 (1850–1990 MHz). None of the above mentioned antennas can meet this requirement. The presently known antennas do not have enough bandwidth to be used directly in this four band application without incurring significant loading loss at one or more of the desired operating frequency bands.

SUMMARY OF THE INVENTION

It should be emphasized that the term "comprises/comprising" when used in this specification is taken to specify the presence of stated features, integers, steps or components but does not preclude the presence of addition of one or more other features, integers, steps, components or groups thereof.

Generally, the present invention includes compact antennas utilizing capacitive coupling between multiple conductive plates that achieves broad bandwidth. The capacitive coupling between the conductive plates may create a variable capacitance, inductance, and/or impedance as a function of frequency that increases the bandwidth. The number and design of conductive plates may be set to achieve the desired bandwidth and/or the number of distinct transmission frequencies for a particular application. The antenna may include capacitive coupling for the antenna feed and capacitive coupling of a parasitic conductive plate.

To achieve compact size and broad bandwidth, the antenna may include, for example, three or more layers of conductive plates or traces. One layer may be a feeding patch, one layer may be a main patch, and one layer may be a secondary patch. The secondary patch may be a parasitic patch. The main patch and/or the secondary patch may include one or more distinct areas which will be resonant at predetermined desired frequencies that has wider bandwidth due to the capacitive coupling between the various conductive plates. All of the conductive plates may be micro-strips and approximately parallel to one another and may have connection pins approximately parallel with one another. The conductive plates may be approximately parallel with a substrate and the connection pins may be approximately perpendicular to the substrate and conductive plates so as to form an L shape with the conductive plates. The orientation of the various conductive plates may be in any order and two of the conductive plates may be adjacent to each other on the same plane. However, their respective connection terminals for connecting to ground or feed should be located relatively close to one another. The distance between the various conductive plates to one another and to the substrate may be set to tune the antenna to resonate at the desired frequencies. The substrate may include a dielectric and/or a ground plane. The conductive plates may be formed on an antenna carrier positioned above the dielectric and/or ground plane having air in between. The conductive plates may be of any geometrical shapes and be two dimensional (e.g., planar) or three dimensional.

In various embodiments, an antenna may be designed to operate approximately within four radio frequency ranges, for example, 824–894 MHz (GSM-800), 880–960 MHz (GSM-900), 1710–1880 MHz (GSM-1800), and 1850–1990 MHz (GSM-1900). The antenna may be referred to as a four band or quad-band antenna. The antenna in this case may have multiple conductive plates that resonate at multiple frequencies approximately within the desired frequency ranges. For example, the antenna may include three L shaped portions (or legs) each including a micro-strip conductive plate and connection pin, with configurations approximately parallel to one another. The L shaped portions may be in close proximity with one another and separated by, for example, a dielectric, to take advantage of capacitive and inductive coupling. Two of the L shaped portions may be adjacent to one another on the same plane or all three may be on three separate planes mounted on an antenna carrier above the ground plane. In one variation, the lower L shaped portion may be, for example, a feed patch with a feed pin that provides a connection to a transmitter, receiver, or transceiver. The upper L shaped portion may be, for example, a dual band main patch and ground pin that is designed of two different branches with different lengths and areas so as to handle two or three of the four desired resonant frequencies. The two branches may share a common junction and may be right angled rectangular traces that turn back in a spiral or U-type shape starting at a right angle from the common feed junction. The third L shaped portion may be, for example, a parasitic high band patch and ground pin designed to handle one of the two higher desired resonant frequencies. This L shaped portion may be located adjacent to and on the same plane as the upper L shaped portion, in between the upper L shaped portion and the lower L shaped portion, on the same plane as the lower L shaped portion, of below the lower L shaped portion. The three L shaped portions (or legs) may be separate from each other and a mounting substrate by dielectric material such as air, plastic, etc. The substrate may be, for example, a printed circuit board (PCB) including a ground plane and the L shaped portions or legs may be, for example, printed conductive traces formed on an antenna carrier or on a dielectric supported by the PCB. In one preferred variation, the dual band main patch is above the feeding patch and the parasitic high band patch is adjacent the dual band main patch. In another variation, the positions of the dual band main branch and the feeding patch may be inverted so that the dual band main branch is below the feeding patch and the parasitic high band patch is adjacent the feeding patch. All three patches are capacitively coupled to one another and designed to provide four resonant frequencies useful for radio communications while having only a single feed pin or terminal connection to a receiver, transmitter, and/or transceiver.

In another embodiment, the patches, and particularly the two branches of the dual band main patch, may have a T or double U shape. Alternatively, the dual band main patch may be segregated into two patches, a longer patch for lower bandwidth, and a shorter patch for the higher bandwidth. Various geometrical configurations are possible for the various antenna patches, including 3-dimensional plates.

BRIEF DESCRIPTION OF THE DRAWINGS

The objects, features and advantages of the present invention will become more readily apparent to those skilled in the art upon reading the following detailed description, in conjunction with the appended drawings, in which.

DETAILED DESCRIPTION OF THE INVENTION

In general, the present invention is directed to compact broadband antennas. In various embodiments the antennas are capacitive feed micro-strip antennas having a low profile that is small in size and light in weight. These antennas are particularly advantageous for use as built-in type antennas used in compact multi-function mobile communication devices (e.g., reduced size enhanced function mobile telephones, that operating in a broad frequency range such as 300 MHz–3000 MHz). For example, the communication devices including the compact broadband antenna may support such functions as cellular telephone, wireless local area network, GPS and diversity connectivity. Wide frequency bandwidth, low loss, simple and compact antennas are provided. In one preferred embodiment, the antenna is a compact multi-band multi-layer 3L antenna particularly useful as a miniature built-in type antenna capable of supporting a four band application, such as application covering the Global System for Mobile communications-800 (GSM-800), GSM-900, Digital Communication System (DCS), and Personal Communication System (PCS) frequencies without any loading loss. Note that the GSM-800 has a frequency range centered on 800 MHz, GSM-900 has a frequency range centered on 900 MHz, DCS has a frequency range centered on 1800 MHz, and PCS has a frequency range centered on 1900 MHz.

Figure 1A:
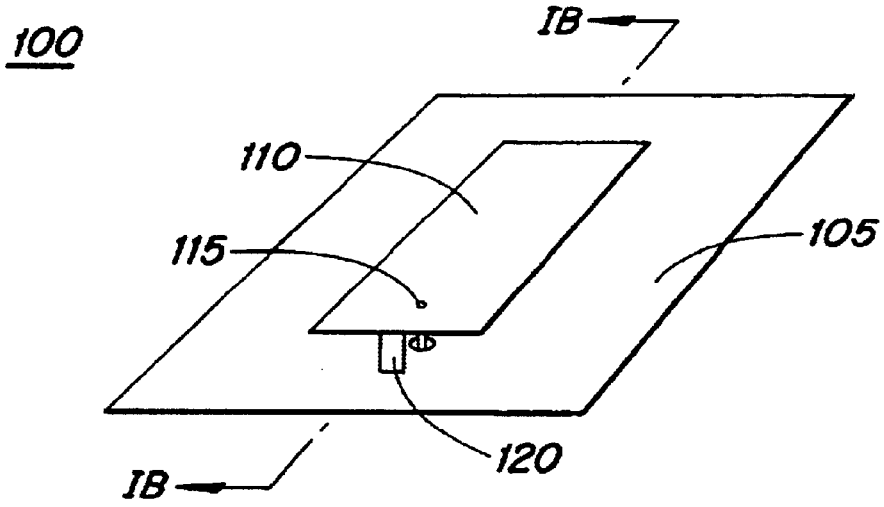
FIG. 1A (PRIOR ART)
FIG. 1A depicts a perspective view of an exemplary prior art planar inverted F antenna (PIFA)
Figure 1B:
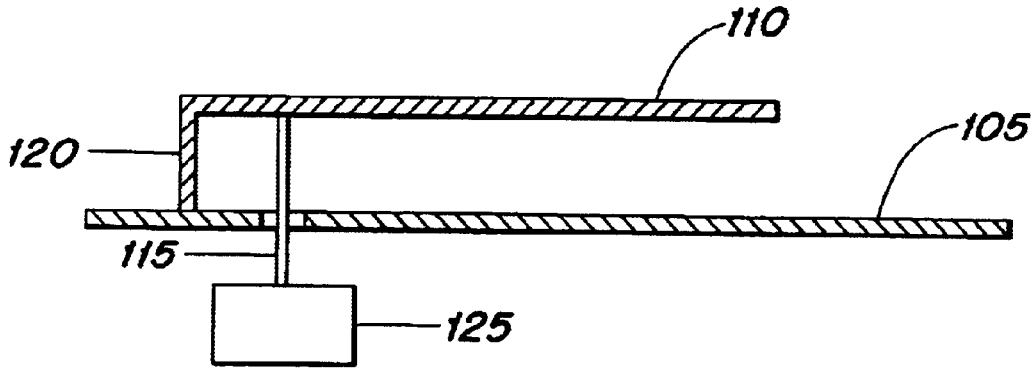
FIG. 1B (PRIOR ART)
FIG. 1B illustrates a cross-sectional view taken across line IB—IB of the exemplary prior art PIFA shown in FIG. 1A.

As previously discussed, the conventional PIFA printed patch antenna shown in FIGS. 1A and 1B is often used in the mobile telephone due to its compact size but has a relatively narrow bandwidth. The bandwidth of the antenna depends in part on the thickness of the substrate and the method of connecting the antenna resonant patch to the signal source and/or receiver. As illustrated in FIGS. 1A and 1B, this PIFA has a fixed feed connection 115 with a fixed capacitance and inductance resulting therefrom. Further, this PIFA has a single length and area resonant patch 110. As a result, the bandwidth of a typical directly connected feed PIFA is limited by the Q value of the antenna structure and has limited bandwidth that is not capable of supporting more than a single resonant frequency operation for one of the GSM/DCS/PCS bands.

Figure 2:
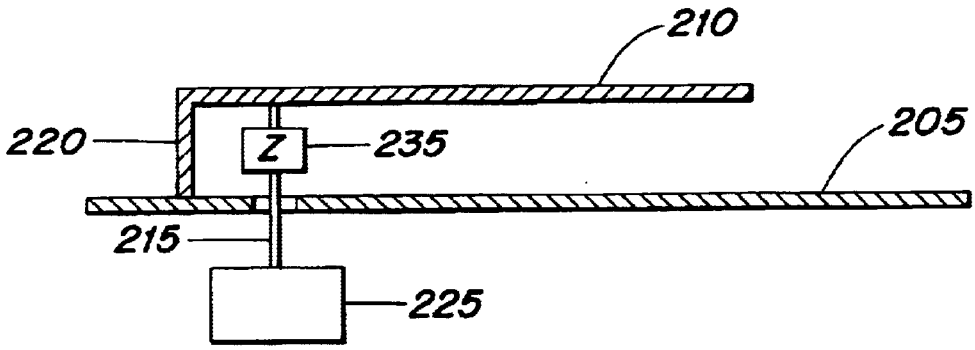
FIG. 2 depicts an illustration of a theoretical approach to increasing bandwidth by varying load on the resonant antenna patch.

However, theoretically if an antenna were designed to have a variable characteristic impedance, the bandwidth would be enhanced. A modified conventional PIFA is shown in FIG. 2 to explain this theory. Like the PIFA of FIGS. 1A and 1B, the modified PIFA includes an antenna patch 210 that is parallel to a ground plane 205. The antenna patch 210 is connected at one end to the ground plane 205 with a ground pin 220. The antenna patch 210 is also connected to a signal receiver, transmitter, and/or transceiver 225 via a feed pin 215. However, the antenna patch is loaded with capacitance or inductance Z 235. This capacitance or inductance (reactance) loading Z 235 may be, for example, a variable reactance and will shift the resonant frequency of antenna patch 210; that is, when Z 235 changes, the resonant frequency will shift.

Figure 3:
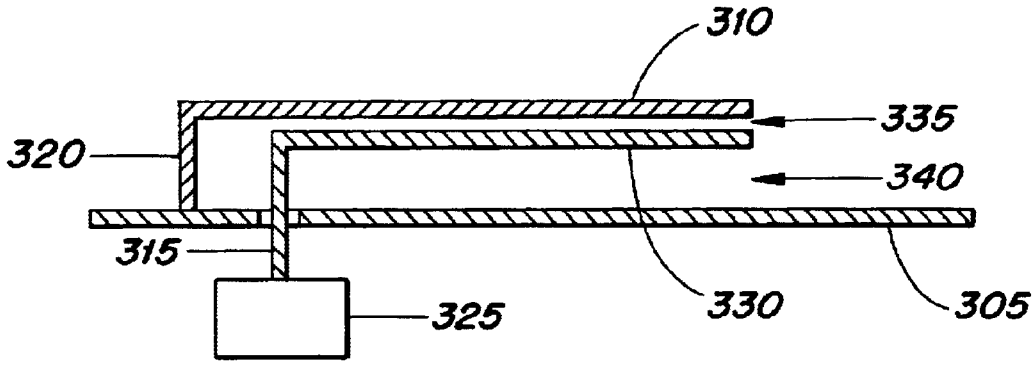
FIG. 3 depicts a cross-sectional view of an exemplary capacitive feed patch antenna.

Further, if the reactance loading can be made to vary as a function of the frequency, the matching of the antenna resistance to the system RF port resistance (e.g., 50 ohms) can follow the frequency range and the bandwidth can be enhanced. Ideally, the antenna impedance should have a reactance loading close to zero and a resistance of close to the system RF port resistance. Generally, the matching varies with frequency. One way to realize a variable reactance loading is to use capacitive feeding to create a distributed capacitance between a main patch and a feeding patch as illustrated in FIG. 3. In this example, the PIFA is modified to have a capacitive feed and may have two L shapes (as can be seen from the side view of the antenna in FIG. 3) instead of the F shape of a PIFA (formed by the combination of the patch, feed pin and ground pin). This may be referred to as a capacitive fed 2L patch antenna. As shown in FIG. 3, the antenna may have a main patch 310 parallel to a ground plane 305. A ground pin 320 electrically connects the main patch 310 to the ground plane 305 and is approximately perpendicular to both. A feeding patch 330 is approximately parallel to, and placed between, the main patch 310 and the ground plane 305. The feeding patch 330 is electrically connected to, for example, a transceiver 325 via a feeding pin 315. This 2L antenna has a broader bandwidth than the conventional PIFA antenna by virtue of its distributed capacitance, loading reactance and matching. For example, this technique may more than double the bandwidth at some frequencies. Although, this broader bandwidth is likely to cover a frequency range from the GSM-800 to the GSM-900 frequency bands, it is not sufficiently broad to cover a broader frequency range such as required to span from the GSM-800 to the PCS frequency bands.

To support such a broad frequency band for the GSM-800/GSM-900/DCS/PCS application, consideration is given to the target frequency bands. There are four target frequency bands that have two distant bands separated by one octave (1000 MHz); the 800–900 MHz frequency bands (low frequency band) are one octave from the 1800–1900 MHz frequency bands (high frequency band). To realize multi-band functions one octave apart, the main patch may include a dual band main patch and the feeding patch may have a special shape to produce the distributed capacitance. For example, the dual band main patch and the feeding patch may have multiple elements or branch, each directed to achieving a different resonance. As such, the antenna may have one element (branch) to achieve resonance at the low band and another element (branch) to achieve resonance at the high band. These two elements may be included in an appropriate shape in the dual band main patch and the feeding patch and may generally support the 800–900 MHz frequency bands and the 1800–1900 MHz frequency bands, respectively. Further, one or more extra parasitic element(s) may be included that, for example, resonate at one of the high frequency bands or low frequency bands so as to further broaden the bandwidth of the antenna. As such, the antenna may have three L shaped portions including a dual band main patch, feeding patch, and parasitic patch and may be referred to as a "Multi-Band Dual Layer 3L Antenna". Exemplary antenna designs that may efficiently support the GSM-800/GSM-900/DCS/PCS quad-band applications are shown in FIGS. 4A–4C and 7.

With the introduction of the capacitive feeding technique the antenna can offer a distributed capacitance as a function of frequency and obtain increased bandwidth for a given geometry. If both the dual band main patch and the feeding patch are optimized to this requirement, the bandwidth at low band can be increased from 8% to 28%. For example, the patches may be designed to an antenna impedance where, for example, the reactance is near zero the resistance is near 50 ohms. Further, the use of an additional parasitic patch enables coverage of broad bandwidth at the high band. Thus designed, the antenna can cover the multi-band application including, for example, 800, 900, 1800, and 1900 MHz bands.

Figure 4A:
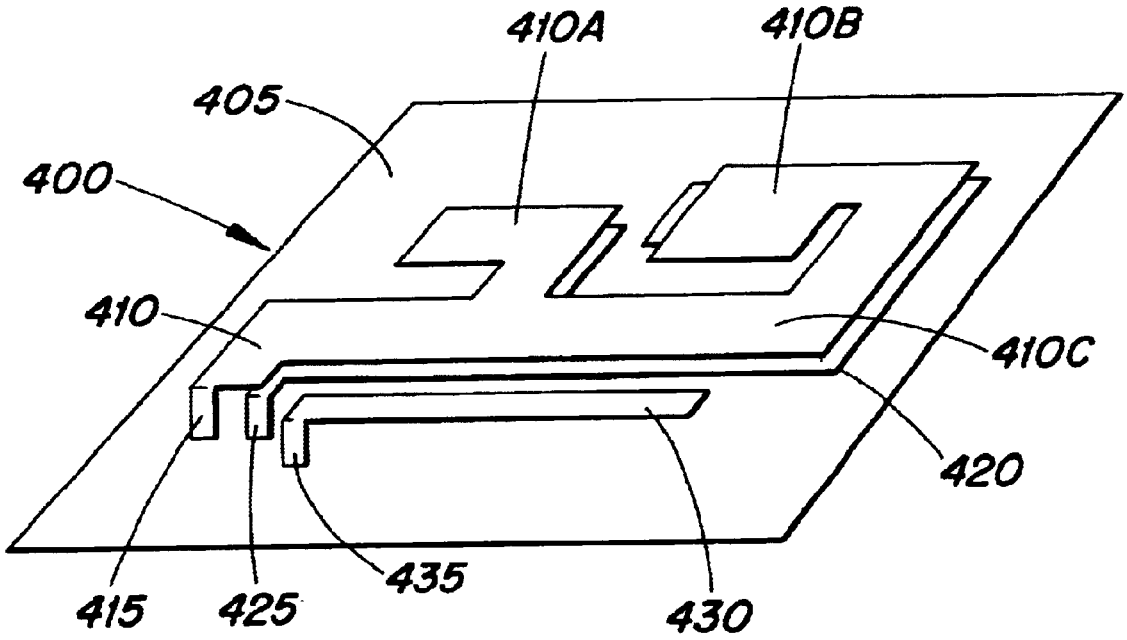
FIG. 4A depicts a perspective view of one exemplary compact broadband capacitive feed antenna.
Figure 4B:
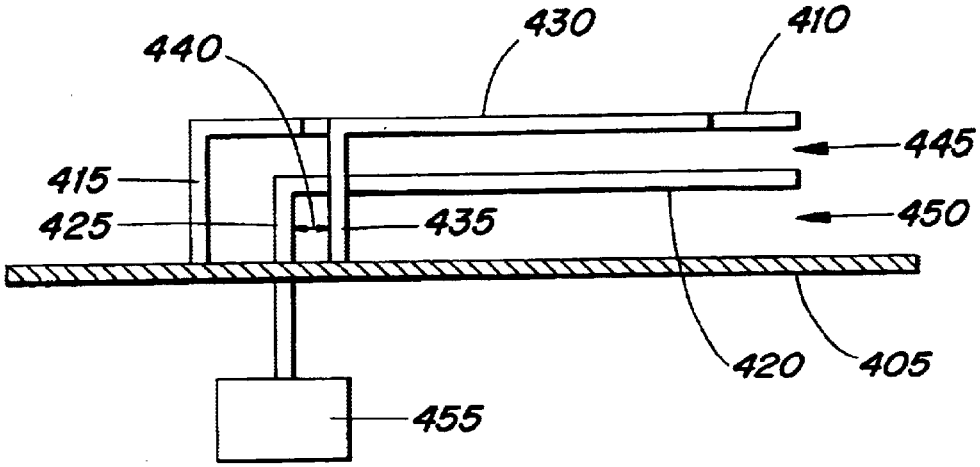
FIG. 4B depicts a cross-sectional view taken across line IVB—IVB of the exemplary broadband capacitive feed antenna shown in FIG. 4A.
Figure 4C:
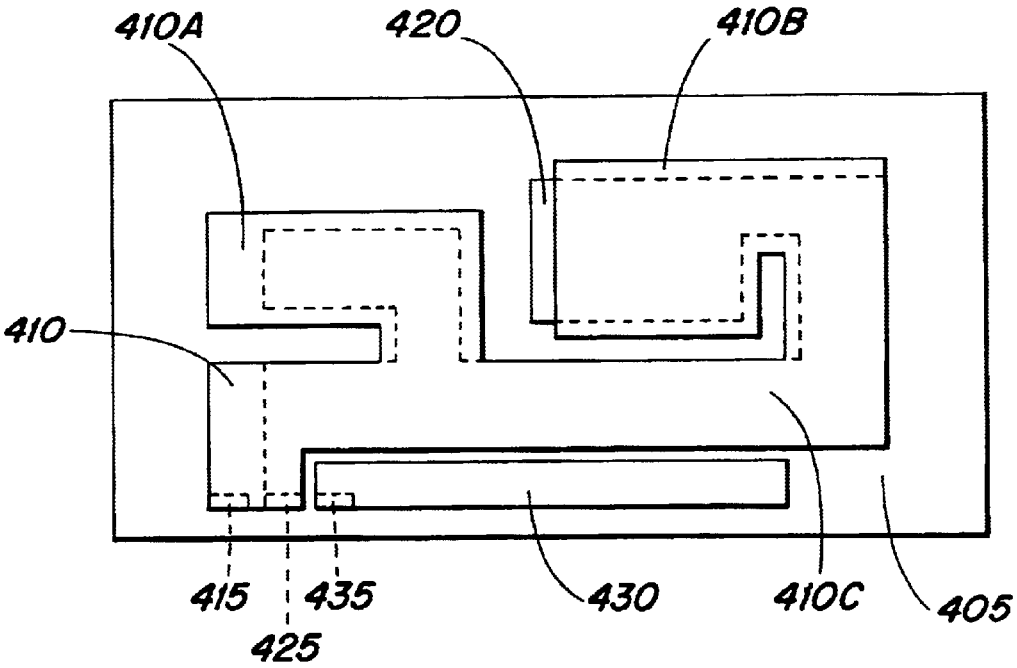
FIG. 4C depicts a plan view of the exemplary broadband capacitive feed antenna shown in FIG. 4A.

Referring now to FIGS. 4A–4C, one particular exemplary multi-band 3L antenna for GSM-800/GSM-900/DCS/PCS quad-band applications is illustrated in a perspective view, side view, and top view, respectively, and will now be described. The multi-band 3L antenna 400 may be formed over a substrate 405. The antenna is comprised of three conductive plates and respective connection pins that each form an L shape (in this case 3 L shapes) when viewed from the side. The conductive plates (e.g., dual band main patch 410) and connection pins (e.g., main patch ground pin 415) may be made of a metal, for example, copper, aluminum, gold, and the like, that is stamped or etched. The antenna 400 may be supported over the substrate 405 at a predetermined distance using a dielectric frame or material such as an antenna carrier (not shown). The substrate 405 may be, for example, a printed circuit board (PCB) or a mobile communication device chassis or case. In a preferred embodiment, the substrate 405 may include a dielectric and a conductive plate that functions as a ground plane. In a preferred embodiment, the substrate may be a PCB in a mobile telephone and having dimensions, for example, of approximately 40 mm in a first direction (e.g., X direction) and 18 mm in a second direction (e.g., Y direction), where the first and second directions are perpendicular.

One conductive plate, referred to herein as the dual band main radiator patch 410, may have two branches, a shorter smaller branch 410A and a longer larger branch 410B connected to a common joint path or junction 410C. The common joint path or junction 410C is connected at one end to a ground terminal or pin, the main patch grounding pin 415. The grounding pin 415 may be perpendicular to the dual band main patch 410 and connected to ground, for example, to a ground plane included with the substrate 405. As such, it has an L shape when viewed from a front side view (see FIG. 4B). The two branches, 410B and 410C, may be angled rectangular traces or planes that branch off at right angles from the common joint path or junction conductor 410C and turn back toward the ground pin connection in a spiral or U-type shape from the common path or junction 410A. In the exemplary embodiment, the longer larger branch conductor 410B is connected to a second end of the common joint path or junction conductor 410C, opposite the first end connected to the ground pin 415, and supports lower frequency bands (e.g., 800 and/or 900 MHz). The shorter smaller branch conductor 410A is connected to approximately the middle of the common joint path or junction conductor 410C trace and supports high frequency bands (e.g., 1800 and/or 1900 MHz).

Another conduction patch, herein referred to as the feeding patch 420, may be formed under the dual band main patch 410, have a geometric shape that is similar to the dual band main patch 410, and be properly designed to create a distributed capacitance to enhance the bandwidth. For example, as indicated in FIG. 4C the conductive portion of the feeding patch 420 (related to the low frequency band) is narrower and longer then the overlapping low band main patch conductor portion 410B and the conductive portion of the feeding patch 420 (related to the high frequency band) is narrower and shorter than the overlapping high band main patch conductor portion 410A. Although, both may have lengths that are close to ¼ wavelength of the desired frequencies. Further, the dual band main patch 410 and the feeding patch 420 may have resonant frequencies that are close to one another, but not the same, to expand the bandwidth.

As most clearly shown in FIG. 4B, the feeding patch 420 has a feeding terminal or pin, feeding pin 425, approximately perpendicular to its planar surface and the dielectric substrate 405 that electrically connects the feeding patch 420 to an electronic circuit 455. As such, this antenna segment too has an L shape when viewed from a front side view. The electronic circuit 455 may be, for example, a receiver, transmitter, and/or transceiver for sending and/or receiving electronic signals from/to the feeding patch 420. In a preferred embodiment, the electronic circuit 455 is mounted on the dielectric substrate 405 and a metal trace included in the dielectric substrate 405 electrically connects the electronic circuit 455 to the feeding pin 425 and to the feeding patch 420. Further, the dual band main patch 410 and the feeding patch 420 have a predetermined gap or distance 445 set between them. This gap or distance 445 is important to controlling the antenna matching. The matching of the antenna impedance to the output port impedance of, for example, the transceiver (e.g., 50 ohms) can be adjusted by changing the distance between the main patch 410 and the feeding patch 420. However, a change in coupling may be caused by changing the distance between the main patch 410 and the feeding patch 420 and vary the resulting resonant frequencies. Thus, as the gap 445 is changed the geometry of the main patch 410 and/or the feeding patch 420 may need to be changed to maintain particular desired frequencies. Further, the location of the ground pin 415 and the feed pin 425 may need be adjusted to achieve the desired system impedance matching since this distance helps determine the antenna resistance and its match to, for example, the transceiver output port resistance. In any case, the gap or distance 445 may be filled with a dielectric material such as a foaming material or plastic material.

As indicated, the antenna as constructed includes capacitive coupled feed between the dual band main patch 410 and the feeding patch 420 (and their respective conductive pins 415 and 425). The dual band branches (e.g., conductive branches 410A and 410B) will thus operate to provide a broader bandwidth coverage of both low frequency bands and high frequency bands. However, even with the capacitive coupled feed, only one of the DCS or PCS bands can be covered by the high frequency band resonant branch 410A. So, to realize quad-band capability, another conductive patch or high band resonant patch, referred to herein as the parasitic high band patch (or branch) 430, using capacitive coupling is included in the antenna 400. In one embodiment, the element is designed to be resonant nearby the first high band resonance frequency, for example, 1900 MHz to support the PCS bandwidth. As such, the size, location, and distance from the other patches and the substrate of the parasitic high band patch 430 are set to tune this patch to the desired high frequency band, so that it is, like the other patches, about a quarter wavelength of the band. The parasitic high band patch 430 is also made of conductive material such as a metal and is approximately parallel to the substrate 405. Further, the parasitic high band patch 430 is connected at one end to a ground terminal or pin, ground pin 435, that is approximately perpendicular to it and the substrate 405. As such, it too has an L shape when viewed from a front side view. The grounding position of the ground pin 435 should be near the location of the feeding pin 425 to get proper coupling. For example, in FIG. 4B the distance 440 between the ground pin 435 and feeding pin 425 may be between 0.1 mm and 1.0 mm, preferably 0.5 mm. The parasitic high band patch 430 and ground pin 435 are electrically connected to ground that in one embodiment may be a ground plane included with substrate 405. The parasitic high band patch 430 is fed by capacitive coupling from the feeding patch 420 and may have a minor frequency shift from capacitive coupling to the dual band main patch 410. Note that the antenna has a single feed port connection (i.e., feeding pin 425) and the parasitic high band patch 430 and the dual band main patch 410 have the opposite phase of the feeding patch 420 because of the capacitive coupling.

As can be seen clearly from FIG. 4B, the construction of the three patches, 410, 420, and 430, and their respective connector pins, 415, 425, and 435, results in an antenna with three L shapes. As more clearly indicated by considering FIGS. 4B and 4C together, in this embodiment the parasitic high band patch 430 is formed adjacent to, parallel with, and on the same plane as the dual band main patch 410.

An experimental antenna according to FIGS. 4A–4C was constructed and simulated to establish the antenna performance. In this case, the antenna was mounted on a PCB and the dielectric material between the dual band main patch 410, the parasitic high band branch 430, and the feeding patch 420 was foaming material. The right branch 410B was tuned for the GSM bands (800 and 900 MHz bands), the left branch 410A was tuned for the DCS band (1800 MHz band) and the bottom patch (the parasitic high band patch) 430 was tuned for the PCS band (1900 MHz band). The overall size of the planar patch area as shown in FIG. 4C was in general 40 mm long (x-direction) and 18 mm wide (y-direction).

Figure 5:
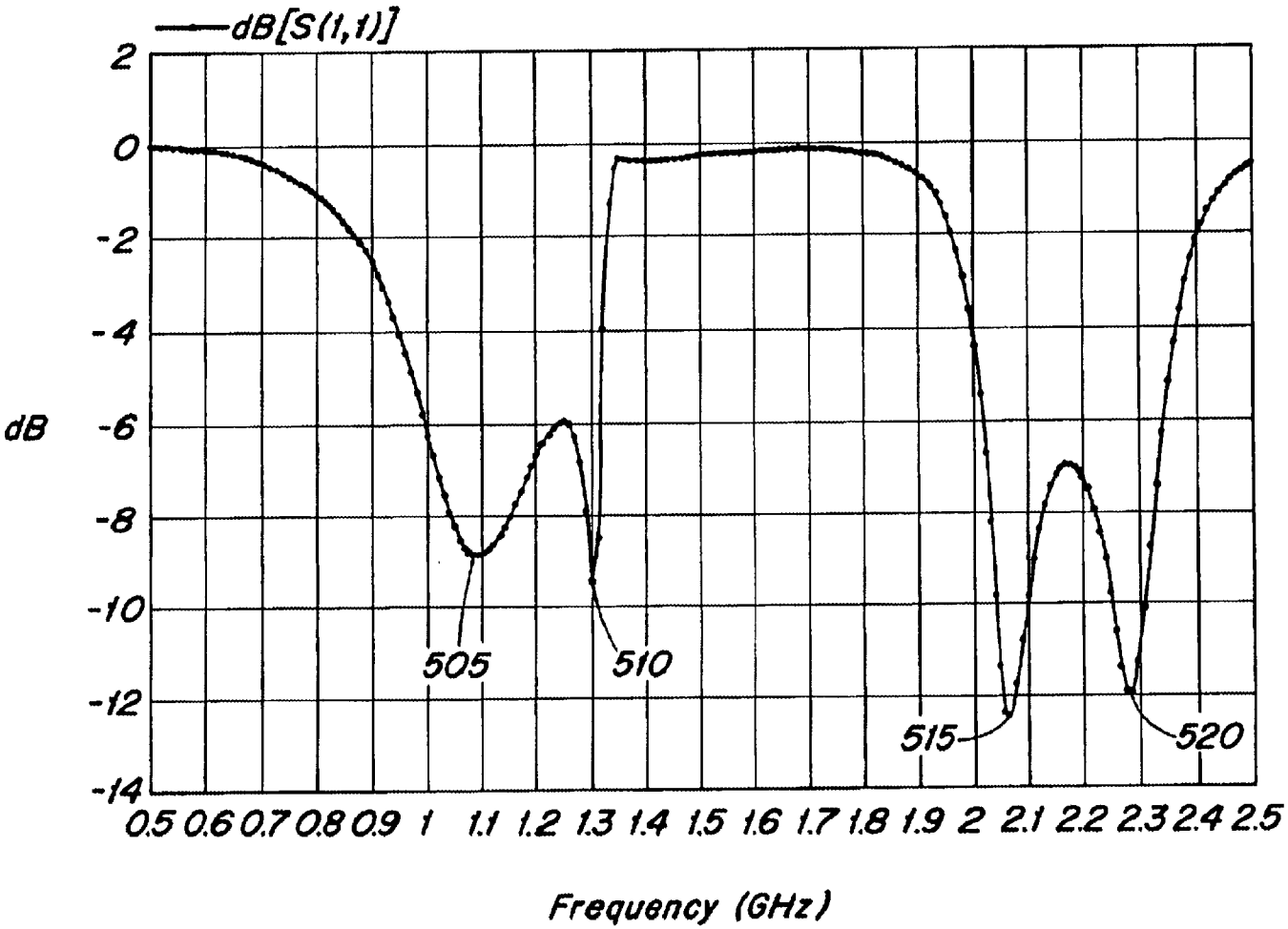
FIG. 5 is a graph illustrating a simulated frequency response (without loading) of the exemplary antenna shown in FIG. 4A.

A simulated frequency vs. return loss plot for this antenna without loading is shown in FIG. 5. The results are shown with return loss in this simulation represented in dB along the Y-axis and the frequency is charted from 500 MHz to 2.5 GHz along the X-axis. As indicated, the antenna has four distinct resonant frequency bands with best performance points, 505, 510, 515, and 520. The two lower resonant frequencies are at points 505 and 510. The lowest resonant frequency point 505 occurs at approximately 1.1 GHz and has a return loss of approximately −9 dB. The next lowest resonant frequency point 510 is at a slightly higher frequency, approximately 1.3 GHz and has a return loss of approximately −9.5 dB. The two higher resonant frequencies are at points 515 and 520. The lower of the two high frequency resonant points, 515, occurs at approximately 2.07 GHz and has a return loss of approximately −12.5 dB. The highest resonant frequency point 510 is at a slightly higher frequency, approximately 2.3 GHz and has a return loss of approximately −12 dB. However, as noted, this simulation does not include loading from, for example, a dielectric between the respective patches, between the patches and the ground plane, or related to a cover, which if considered will shift the resonant frequency lower. Thus, the return loss has four distinct minimums which may accommodate the desired GSM-800, GSM-900, DCS (1800) and PCS (1900) frequency bands with little return loss.

Figure 6:
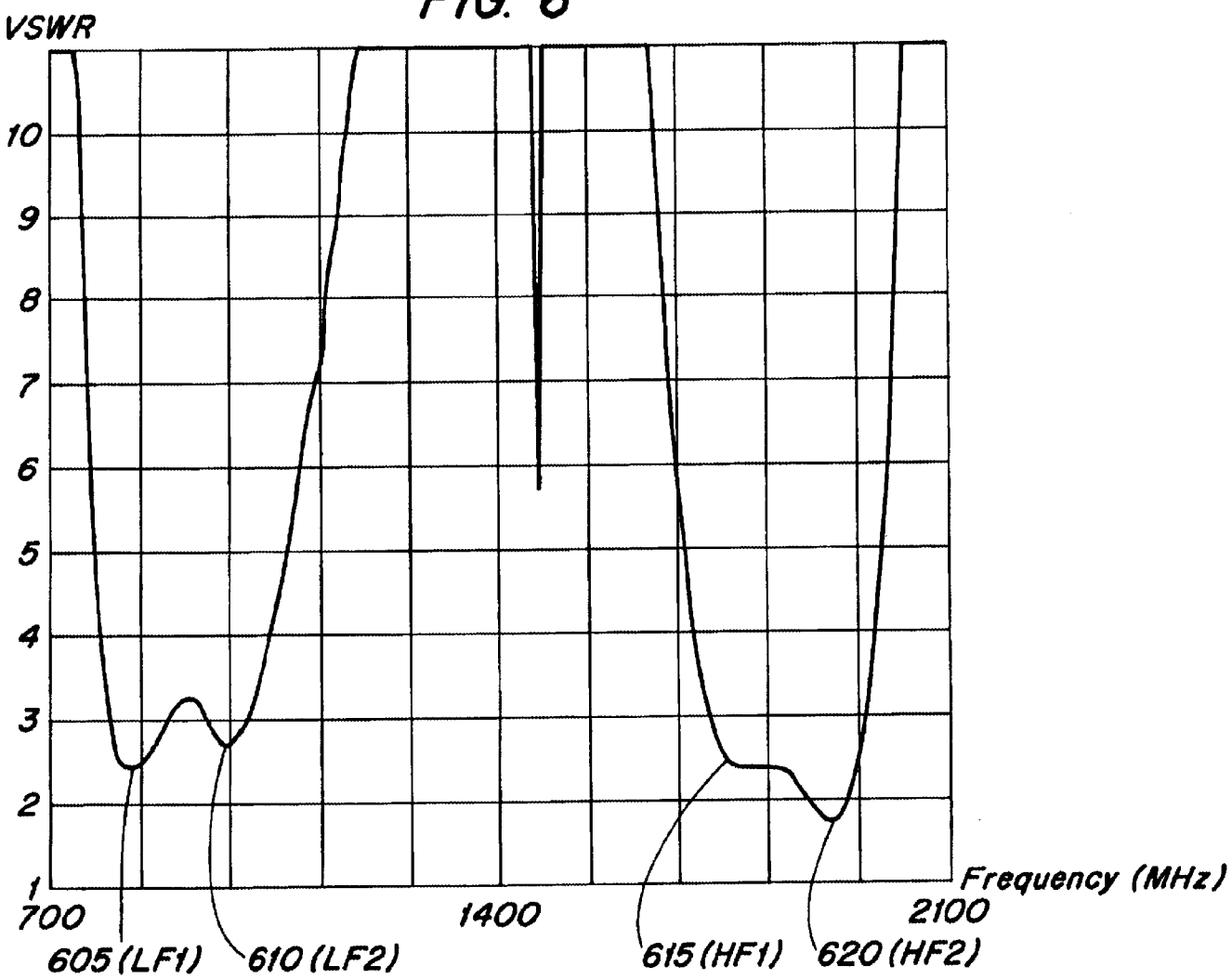
FIG. 6 is a graph illustrating an actual frequency response for an operational exemplary antenna shown in FIG. 4A.

Similar results were obtained for an actual prototype antenna performance, as is shown in FIG. 6. In this experiment voltage standing wave ratio (VSWR) is used to indicate the performance (ratio of power forward to power reflected) rather than return loss in dB. Although it is recognized that these measures of performance are linearly related. In this case, the antenna's actual performance is shown with VSWR along the Y-axis and the frequency from 700 MHz to 2100 MHz (2.1 GHz) along the X-axis. Each gradation on the X-axis represents an increase of 140 MHz. As indicated, the actual exemplary antenna has four distinct resonant frequency bands with best performance points, 605, 610, 615, and 620. The two lower resonant frequencies are at points 605 and 610 and may be referred to as low frequency 1 (LF1) and low frequency 2 (LF2), respectively. The lowest resonant frequency point 605 (LF1) occurs at approximately 820 GHz and has a VSWR of approximately 2.5. Note that the lower the VSWR the better the return loss and antenna matching, i.e., the better the antenna performance. The next lowest resonant frequency point 610 (LF2) is at a slightly higher frequency, approximately 980 MHz, and has a VSWR of approximately 2.6. Around and between LF1 and LF2 the antenna performs reasonably well so as to support the lower GSM-800 and GSM-900 frequency bands. The two higher resonant frequencies are at points 615 and 620 and may be referred to as high frequency 1 (HF1) and high frequency 2 (HF2), respectively. The lower of the two high frequency resonant points, 615, occurs at approximately 1780 MHz and has a VSWR of approximately 2.5. The highest resonant frequency point 620 is at a slightly higher frequency, approximately 1900 MHz and has a VSWR of approximately 1.8. Around and between HF1 and HF2 the antenna performs reasonably well so as to support the higher DCS (1800 MHz) and PCS (1900 MHz) frequency bands. As illustrated, the frequency performance of an actual implementation of the antenna shown in FIGS. 4A–4C results in two relatively broad bands of low loss antenna resonance performance, one including LF1 and LF2, and another including HF1 and HF2. The low band portions of the antenna and the high band portions of the antenna can each be tuned to two separated bands or tuned to one broad band. However, in this case the bandwidth at lower bands is increased from 8% to 28% while the bandwidth of the upper bands is more than doubled. This antenna design can thus be used successfully for broadband applications, for example, in a four band (800, 900, 1900, 1900 MHz) mobile telephone.

Numerous variations for the physical structure and layout of the antenna are possible in order to achieve various desired broadband applications and performance. For example, the location of the various patches and connector pins for the antenna could be varied and still achieve a broadband multi-band antenna. It is only necessary that their respective locations, sizes, shapes, and distance relative to the substrate 405 and to one another be set so as to tune the antenna to the desired frequencies and match the antenna to the system impedance. For example, the parasitic high band patch 430 need not be co-planar with the dual band main patch 410 as previously illustrated in the exemplary embodiment. The parasitic high band patch 430 can be disposed at any height above the substrate as may be acceptable for a particular application and antenna design. Further, the relative location of the various patches may also be changed. For example, the dual band main patch 410 could be below the feeding patch 420. What will work satisfactorily will depend on the frequencies required for a particular application and the system impedance.

Figure 7:
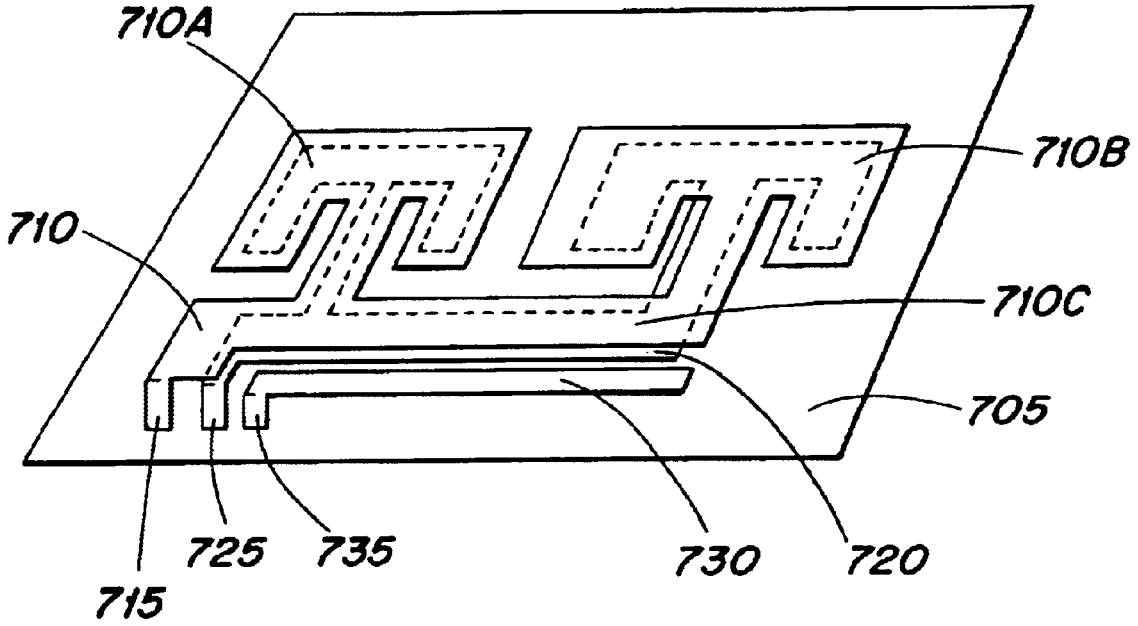
FIG. 7 depicts a perspective view of another exemplary compact broadband capacitive feed antenna.

Further, the conductive patches can be any shape such as, but not limited to, rectangular, triangle, circular, and they can be two dimensional or three dimensional. For example, another exemplary embodiment is illustrated in FIG. 7. In this case, the two branches, 710A and 710B, of a dual band main patch 710 that are directed to separate frequencies, may be formed at right angles to a connector 710C and may have a T or M shape. Once again the feeding patch 720 would have a similar shape as the dual band main patch 710 and may be located below it. Further, the parasitic high band patch 730 may be adjacent to and parallel to the dual band main patch 710. A dielectric material, such as foam, plastic, PCB insulation material (e.g., FR4) and/or ceramic, may separate the dual band main patch 710 and the feeding patch 720. The antenna structure may be supported by a dielectric antenna support frame (not shown), such as a plastic antenna carrier. The dielectric frame may be attached to the substrate 705. The conductor portions of the antenna may be realized by a punched metal plate or an etched metal plate.

In any case, the bandwidth of the antenna depends on the patch shape and size, the thickness of the substrate 705, and the height of the frame from the substrate 705. In general, the larger the patch area, the broader the bandwidth of the antenna. The larger the gap between the patches and PCB edge, the broader the bandwidth of the antenna. Further, the antenna impedance matching to the system impedance can be adjusted by changing the distance between the dual band main patch 710 and the feeding patch 720 as well as the relative distance and size of the parasitic high band patch 730 to the other patches.

Although particular embodiments of the present invention have been shown and described, it will be understood that it is not intended to limit the invention to the various embodiments described herein. It will be obvious to those skilled in the art that various changes and modifications may be made to the embodiments described herein without departing from the spirit and scope of the present invention. Thus, the invention is intended to cover alternatives, modifications, and equivalents, which may be included within the spirit and scope of the invention as defined by the claims. For example, the antenna designs of the present invention are described as being formed on a dielectric or antenna carrier above a substrate. However, the antenna conductive plates may be formed on the case of a mobile communication device or integral within a PCB used as the chassis for the electronic components of a mobile communication device.

All publications, patents, and patent applications cited herein are hereby incorporated by reference in their entirety for all purposes.

What is claimed is:

1. An antenna, comprising:

a first conductive patch;

a second conductive patch capacitively coupled to the first conductive patch; and a third conductive patch capacitively coupled to the first conductive patch, wherein the antenna is connected to a single feed port, and wherein one of the second conductive patch and the third conductive patch is not co-planar with the first conductive patch, wherein the first conductive patch is a feed patch, the second conductive patch is a main patch, and the third conductive patch is a parasitic patch, and wherein the second conductive patch is a dual band main patch having a first branch for resonance at a first frequency band and a second branch for resonance at a second frequency band.

2. The antenna of claim 1, wherein the first frequency band is a low band and the second frequency band is a high band.

3. The antenna of claim 2, wherein the first branch is longer than the second branch.

4. The antenna of claim 3, wherein the first branch has at least a portion having a same shape as the second branch and an added portion.

5. The antenna of claim 4, wherein the first conductive patch is connected to a feed terminal, the second conductive patch is connected to a first ground terminal, and the third conductive patch is connected to a second ground terminal.

6. The antenna of claim 5, wherein the second conductive patch and first ground terminal and the third conductive patch and second ground terminal are fed by the capacitive coupling to the first conductive patch and feed terminal.

7. The antenna of claim 6, wherein the first conductive patch, the second conductive patch, and the third conductive patch are approximately parallel to one another.

8. The antenna of claim 7, wherein the first conductive patch, the second conductive patch, and the third conductive patch are supported over a substrate by a dielectric support member.

9. The antenna of claim 8, wherein the substrate includes a conductive ground plane and the first conductive patch, the second conductive patch, and the third conductive patch are approximately parallel to the ground plane.

10. The antenna of claim 9, wherein the first ground terminal and the second ground terminal are connected to the ground plane and the feed terminal is coupled to a receiver, transmitter, or transceiver.

11. The antenna of claim 10, wherein the second ground terminal is located near the feed terminal to achieve proper coupling.

12. The antenna of claim 11, wherein the second ground terminal is at a distance of from 0.1 mm to 1.0 mm from the feed terminal.

13. The antenna of claim 12, wherein the first conductive patch is proportioned relative to the second conductive patch and creates distributed capacitance to enhance the bandwidth of the antenna.

14. The antenna of claim 13, wherein the conductive patches are each two dimensional or three dimensional.

15. The antenna of claim 14, wherein the first branch is a spiral or U shape and the second branch is a spiral or U shape.

16. The antenna of claim 4, wherein the first branch is a T or M shape and the second branch is a T or M shape.

17. The antenna of claim 16, wherein distance between the first conductive patch and the second conductive patch is set to match the second conductive patch impedance to a communication system impedance.

18. The antenna of claim 17, wherein the first conductive patch, second conductive patch and third conductive patch are physically separated from one another by an insulating material.

19. The antenna of claim 18, wherein at least one of the first conductive patch, the second conductive patch, and the third conductive patch is made of a punched or etched metal.

20. The antenna of claim 19, wherein the first conductive patch, the second conductive patch, and the third conductive patch in combination produce an antenna with four resonant frequencies.

21. The antenna of claim 20, wherein the four resonant frequencies support frequency bands for GSM-800, GSM-900, DCS, and PCS.

22. An antenna, comprising:

a first conductive patch:

a second conductive patch capacitively coupled to the first conductive patch; and a third conductive patch capacitively coupled to the first conductive patch, wherein the antenna is connected to a single feed port, and wherein one of the second conductive patch and the third conductive patch is not co-planar with the first conductive patch, and wherein the second conductive patch is a dual band main patch having a first branch for resonance at a first frequency band and a second branch for resonance at a second frequency band.

23. The antenna of claim 22, wherein the first conductive patch, the second conductive patch, and the third conductive patch in combination produce an antenna with four resonant frequencies for support of frequency bands GSM-800, GSM-900, DCS, and PCS.

24. A mobile communication device, comprising an antenna having a single feed port connection, variable characteristic impedance, and at least four resonant frequencies which are not multiples of a base frequency; and at least three capacitively coupled conductive antenna elements of which the first element is connected to said single feed port, and wherein said at least three capacitively coupled antenna elements interoperate to provide the at least four resonant frequencies, wherein the at least three capacitively coupled conductive antenna elements includes a first conductive patch, a second conductive patch and a third conductive patch, each capacitively coupled to one another, and wherein one of the second conductive patch and the third conductive patch is not co-planar with the first conductive patch.

25. The mobile communication device of claim 24, wherein the four resonant frequencies are approximately 800 MHz, 900 MHz, 1800 MHz, and 1900 MHz so as to support GSM-800, GSM-900, DCS, and PCS radio frequency band communications.

26. The mobile communication device of claim 24, wherein the first conductive patch is connected to a feed terminal that is associated with the feed port, the second conductive patch is connected to a first ground terminal, and the third conductive patch is connected to a second ground terminal.

27. The mobile communication device of claim 26, wherein the second conductive patch is a dual band main patch having a first branch for resonance at a first frequency band and a second branch for resonance at a second frequency band.

28. The mobile communication device of claim 27, wherein the conductive patches are tuned so that the DCS and the PCS resonance frequencies related antenna elements create one broad band that supports both DCS and PCS communications.

29. A mobile communication device, comprising:

an antenna including a plurality of physically separate and capacitive fed conductors that resonate at multiple frequencies so as to support radio communications at GSM-800, GSM-900, DCS, and PCS frequency bands, wherein the plurality of physically separate and capacitive fed conductors includes a first conductive patch connected to a feed point, a second conductive patch connected to a first ground point, and a third conductive patch connected to a second ground point, and wherein one of the second conductive patch and the third conductive patch is not coplanar with the first conductive patch.

30. The mobile communication device of claim 29, wherein the second conductive patch is a dual band main patch having a first branch for resonance at a first frequency band and a second branch for resonance at a second frequency band.

* * * * *